US006798387B2

(12) United States Patent
Cockell et al.

(10) Patent No.: US 6,798,387 B2
(45) Date of Patent: Sep. 28, 2004

(54) SECURE NON-PENETRATING FLAT ROOF MOUNT FOR A SATELLITE ANTENNA AND FOR USE WITH A BALLAST

(76) Inventors: Steven Robert Cockell, 9241 Erin-Garafraxa Townline, Orton, Ontario (CA), L0N 1N0; David John Mawle, 8 Pinnacle Street, Belfountain, Ontario (CA), L0N 1B0

( * ) Notice: Subject to any disclaimer, the term of this patent is extended or adjusted under 35 U.S.C. 154(b) by 154 days.

(21) Appl. No.: 10/273,254

(22) Filed: Oct. 18, 2002

(65) Prior Publication Data

US 2003/0076273 A1 Apr. 24, 2003

Related U.S. Application Data

(60) Provisional application No. 60/330,098, filed on Oct. 19, 2001.

(51) Int. Cl.[7] ..... H01Q 1/12

(52) U.S. Cl. ..... 343/878; 343/880; 343/890

(58) Field of Search ..... 343/878, 880, 343/890; 52/27, 40, 292; 248/523, 539, 910

(56) References Cited

U.S. PATENT DOCUMENTS 4,649,675 A * 3/1987 Moldovan et al. ..... 52/27
4,922,264 A * 5/1990 Fitzgerald et al. ..... 343/878
5,142,293 A * 8/1992 Ross ..... 343/840
5,760,751 A * 6/1998 Gipson ..... 343/880

* cited by examiner

*Primary Examiner*—Tan Ho
(74) *Attorney, Agent, or Firm*—Patrick J. Hofbauer

(57) ABSTRACT

A secure non-penetrating flat roof mount, for a satellite antenna and for use with a ballast, having a base portion that itself has two ballast encasing members. Each of the ballast encasing members defines two different open end faces while, at the same time, substantially enclosing a separate portion of the ballast. The base portion also includes two end caps, with each end cap respectively engaging one open end face on each ballast encasing member. The roof mount is also provided with two tie rods that hold the end caps in place, and in encasing relation, so as to encase the ballast in use. The roof mount also has an antenna supporting member that securely engages the base portion. The antenna supporting member has a sleeve portion that has sockets that in turn accept complementary fasteners in throughpassing relation, so as to secure an antenna mast within the sleeve portion.

19 Claims, 2 Drawing Sheets

SECURE NON-PENETRATING FLAT ROOF MOUNT FOR A SATELLITE ANTENNA AND FOR USE WITH A BALLAST

This application claims the benefit of U.S. Provisional Application No. 60/330,098, filed Oct. 19, 2001.

FIELD OF THE INVENTION

The present invention relates generally to a mount for an antenna, and more particularly, to a secure non-penetrating flat roof mount for a satellite antenna and for use with a ballast.

BACKGROUND OF THE INVENTION

Whether used in association with televisions, telephones, computers, or other technological devices, satellite antennas are increasingly used by people around the world to interact with a multitude of communications, navigation, earth observation, military, weather, and scientific research satellites in their various orbits high above the earth. In order to optimize reception and reduce transmission interference from surrounding structures, satellite antennas are often installed on roof tops of buildings. A recurring problem that needs to be addressed in mounting a satellite antenna on a roof top is that of overcoming the satellite antenna's extreme susceptibility to undesirable movement, and to the possibility that it may become overturned, due to its relatively large surface area and to the erratic and often formidable nature of prevailing winds.

Thus, in the past, in order to provide the desired stability, satellite antennas have been permanently attached to roof tops by means of an attachment assembly that structurally penetrates the building. However, flat roof satellite antenna installations of this sort are typically subject to a number of problems, foremost among these problems being that they are quite complex and expensive. This complexity and costliness is due, in part, to the diversity of different flat roof designs, and to the requirements that must be met in order to maintain both antenna stability and the structural integrity of the building. Furthermore, the location of the satellite antenna is generally restricted to those locations immediately adjacent to a main roof support, or joist, so as to enable engagement of the attachment assembly therewith. As well, this sort of installation also makes it quite difficult to subsequently move the antenna to another location. Of course, further complicating such penetrating roof installations is the fact that breaching the roof top often occasions water leaks, and will likely void any warranty against same that may previously have been in place, thus making it necessary to waterproof or reseal the roof top.

Numerous methods and devices have been developed to overcome these problems by mounting a satellite antenna to a flat roof top without penetrating same, such as, for example, by providing a roof mount with an antenna mast attached to a non-penetrating frame or platform, with a ballast comprising one or more ballasting members being loaded on top of the non-penetrating frame or platform so as to weightedly anchor the roof mount to the flat roof top. Japanese Patent No. 60089102A, issued to Masashige Hiramatsu on May 20, 1985, is an example of such a roof mount. According to designs of this general sort, however, the ballasting members are not physically secured to the non-penetrating frame or platform, such that the ballasting members might easily be removed either by vandals seeking to damage the satellite antenna or disrupt the signal, or by thieves seeking to acquire the satellite antenna for their own use or profit through resale. In any case, the removal of the ballasting members from the roof mount will result in the mounted satellite antenna becoming destabilized and subject to the possibility that it may be overturned in strong wind conditions, or even blown from the roof top.

An example of a device that has been developed to overcome these problems is seen in U.S. Pat. No. 4,922,264 (Fitzgerald et al.) for a SATELLITE ANTENNA MOUNTING APPARATUS WITH BALLAST MEANS. The Fitzgerald patent discloses a satellite antenna flat roof mounting apparatus that has a series of individual ballasting members that are secured to each other and to an antenna mast. Unfortunately, however, the Fitzgerald design shares a problem with other non-penetrating flat roof mount designs so far discussed, in that the ballasting members are directly exposed to the slow destructive forces of the elements and are, therefore, susceptible to erosion and wearing away due to wind, rain, snow, and ice over extended periods of time. This problem is further exacerbated by the fact that these designs typically use concrete or cinder blocks as ballasting members, said blocks being relatively brittle and sensitive to the erosive effects of the weather. As the blocks erode, they become less and less effective as ballasting members, eventually becoming completely ineffective as such. Also, at any stage before the ballasting members are completely eroded, it would be possible for a thief or vandal, using a hammer or similar tool, to apply a force directly to the ballasting members to forcibly detach them from the roof mount. When the ballasting members are already weakened by the erosive forces of nature, they are particularly susceptible to such application of direct force by a human perpetrator, with the result being that the ballasting members may easily become completely detached from the roof mount. In either case, whether by an act of nature or of man, without the ballasting members to weightedly anchor the roof mount to the roof top, the mounted satellite antenna will become unstable and susceptible to overturning and even to the possibility that it might be stolen or blown from the roof top.

An example of a device that effectively overcomes these problems can be seen in U.S. Pat. No. 4,649,675 (Moldovan et al.) for a NONPENETRATING ROOF MOUNT FOR ANTENNA. The Moldovan patent discloses a non-penetrating flat roof mount, having ballasting members positioned on a complex partitioned base and enclosed by ballast covers that are intricately fastened to the base. A significant problem with the Moldovan patent is that, although the ballasting members are both secured to the roof mount and protected from miscreants and the elements, the contemplated ballast covers and base, and the contemplated means by which they are fastened together, are inherently complex and elaborate. As such, the Moldovan roof mount requires the expenditure of a significant amount of time, effort, and cost to assemble or disassemble same during installation, or when it becomes necessary to move or transport the satellite antenna and its roof mount from one location to another.

Examples of other non-penetrating devices that have been developed to mount a satellite antenna in other contexts can be seen in U.S. Pat. No. 5,142,293 (Ross) for a SKYLIGHT ROOF MOUNT FOR A SATELLITE ANTENNA, which device was designed for use on angled roofs only, and in U.S. Pat. No. 5,760,751 (Gipson) for a PORTABLE SATELLITE ANTENNA MOUNT, which device, although not requiring disassembly to be carried by a single person when not in use, is particularly adapted for use with fluid ballast and with small satellite antennas only, such as those antennas used in temporary consumer subscription satellite television systems.

The primary object of the invention is to provide a secure non-penetrating flat roof mount, for a satellite antenna and for use with a ballast, that secures and stabilizes the satellite antenna.

Another object of the invention is to provide a secure non-penetrating flat roof mount, for a satellite antenna and for use with a ballast, that secures the ballast thereto.

A further object of the invention is to provide a secure non-penetrating flat roof mount, for a satellite antenna and for use with a ballast, that increases the resistance of the ballast to the elements and to other external influences.

A still further object of the invention is to provide a secure non-penetrating flat roof mount, for a satellite antenna and for use with a ballast, that does not penetrate a roof top of a building and that reduces the possibility of roof leaks occasioned thereby.

A yet still further object of one aspect of the invention is to provide a secure non-penetrating flat roof mount, for a satellite antenna and for use with a ballast, that effectively distributes the weight of the ballast.

Another object of the invention is to provide a secure non-penetrating flat roof mount, for a satellite antenna and for use with a ballast, that is adjustable, such that the satellite antenna may be any of a wide variety of sizes.

Still yet another object of the invention is to provide a secure non-penetrating flat roof mount, for a satellite antenna and for use with a ballast, that is of simple and cost effective construction and is easily assembled.

An additional object of the invention is to provide a secure non-penetrating flat roof mount, for a satellite antenna and for use with a ballast, that is easily transportable and does not require extensive disassembly to be moved.

Another object of the invention is to provide a secure non-penetrating flat roof mount, for a satellite antenna and for use with a ballast, that is inexpensive to manufacture, transport, and install.

A further object of the invention is to provide a secure non-penetrating flat roof mount, for a satellite antenna and for use with a ballast, that is of reliable construction.

SUMMARY OF THE INVENTION

There is thus provided, according to one aspect of the invention, a secure non-penetrating flat roof mount, for a satellite antenna and for use with a ballast, comprising a base portion. The base portion comprises a first ballast encasing member shaped and dimensioned to substantially enclose a first portion of the ballast and so as to define a first open end face. The base portion further comprises a first end cap adapted to securely and removably engage the first open end face in first encasing relation. The secure non-penetrating flat roof mount further comprises a first tie rod means securely engagable with the base portion to hold the first end cap in the first encasing relation, thereby to encase, in use, a first portion of the ballast. The secure non-penetrating flat roof mount still further comprises an antenna supporting member securely engagable with the base portion.

According to another aspect of a preferred embodiment of the invention, the first ballast encasing member is elongate in shape.

According to a further aspect of the preferred embodiment, the base portion further comprises an elongate second ballast encasing member oriented substantially parallel to the first ballast encasing member.

According to yet another aspect of the preferred embodiment, the second ballast encasing member is shaped and dimensioned to substantially enclose a second portion of the ballast and so as to define a second open end face. The first end cap is also adapted to securely and removably engage the second open end face in second encasing relation.

According to a yet still further aspect of the preferred embodiment, the secure non-penetrating flat roof mount further comprises a second tie rod means securely engagable with the base portion to hold the first end cap in the second encasing relation, thereby to encase, in use, a second portion of the ballast.

According to an even further aspect of the preferred embodiment, the first ballast encasing member is further shaped and dimensioned so as to define a third open end face, and the second ballast encasing member is further shaped and dimensioned so as to define a fourth open end face. The base portion further comprises a second end cap adapted to securely and removably engage both the third open end face in the first encasing relation and the fourth open end face in the second encasing relation.

According to another aspect of the invention, the first tie rod means comprises an elongate first tie rod member that is positionable, in use, substantially within the first ballast encasing member and in first substantially adjacent relation to the first portion of the ballast. The second tie rod means comprises an elongate second tie rod member that is positionable, in use, substantially within the second ballast encasing member and in second substantially adjacent relation to the second portion of the ballast. The first tie rod member and the second tie rod member are each adapted to securely respectively engage the first end cap and the second end cap.

According to a further aspect of the invention, each of the first ballast encasing member and the second ballast encasing member comprises an upper member and a lower member. The lower member of the first ballast encasing member is adapted to securely and removably engage the upper member of the first ballast encasing member to substantially enclose the first portion of the ballast as aforesaid. The lower member of the second ballast encasing member is adapted to securely and removably engage the upper member of the second ballast encasing member to substantially enclose the second portion of the ballast as aforesaid. Each upper member has a "C"-shaped cross-section defined by an upper central base portion and two opposed upper side edge portions, and each lower member has a "C"-shaped cross-section defined by a lower central base portion and two opposed lower side edge portions.

According to a still further aspect of the invention, each of the two opposed upper side edge portions is adapted to frictionally engage, in first overlapping relation, a respective one of the two opposed lower side edge portions.

According to yet another aspect of the invention, each of the first end cap and the second end cap is elongate and has a "C"-shaped cross-section defined by a cap central base portion and two opposed cap side edge portions. Each respective one of the two opposed cap side edge portions is adapted to frictionally engage, in second overlapping relation, both the first ballast encasing member and the second ballast encasing member.

According to an even further aspect of the invention, the antenna supporting member comprises an antenna mast bracket and an elongate antenna mast. The antenna mast bracket is securely engagable with both the base portion and the antenna mast.

According to still yet another aspect of the invention, the antenna mast has a first mast end portion. The antenna mast bracket comprises a longitudinal sleeve portion that has a sleeve end portion. The sleeve end portion is shaped so as to define a longitudinal antenna mast receiving aperture, and the longitudinal antenna mast receiving aperture substantially surrounds, in use, the first mast end portion in selectively removable secured relation.

According to a still further aspect of the invention, the longitudinal sleeve portion of the antenna mast bracket further defines four threaded sockets arranged two each in two vertically aligned pairs of said threaded sockets. The antenna supporting member further comprises four complementary threaded mast fasteners. Each of the mast fasteners is adjustably positionable in screw-threaded, throughpassing engagement within a respective one of the threaded sockets, thereby to adjustably engage the antenna mast in selectively removable secured relation.

According to another aspect of the invention, each of the vertically aligned pairs of the threaded sockets is positioned in axially intersecting, opposed relation, relative to each other of the vertically aligned pairs of the threaded sockets and relative to a cross-sectional center of the longitudinal sleeve portion.

According to a further aspect of the preferred embodiment, the antenna supporting member further comprises a first mast brace securely engagable with both the antenna mast and the base portion.

According to a still further aspect of the preferred embodiment, the antenna supporting member is securely engagable with both the first end cap and the second end cap.

According to yet another aspect of the preferred embodiment, the antenna mast bracket is securely engagable with the first end cap.

According to another aspect of the preferred embodiment, the antenna supporting member further comprises a second mast brace. Both the first mast brace and the second mast brace are securely engagable with both the antenna mast and the second end cap.

Lastly, according to a further aspect of the preferred embodiment, both of the antenna mast and the longitudinal sleeve portion are substantially cylindrical in shape.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
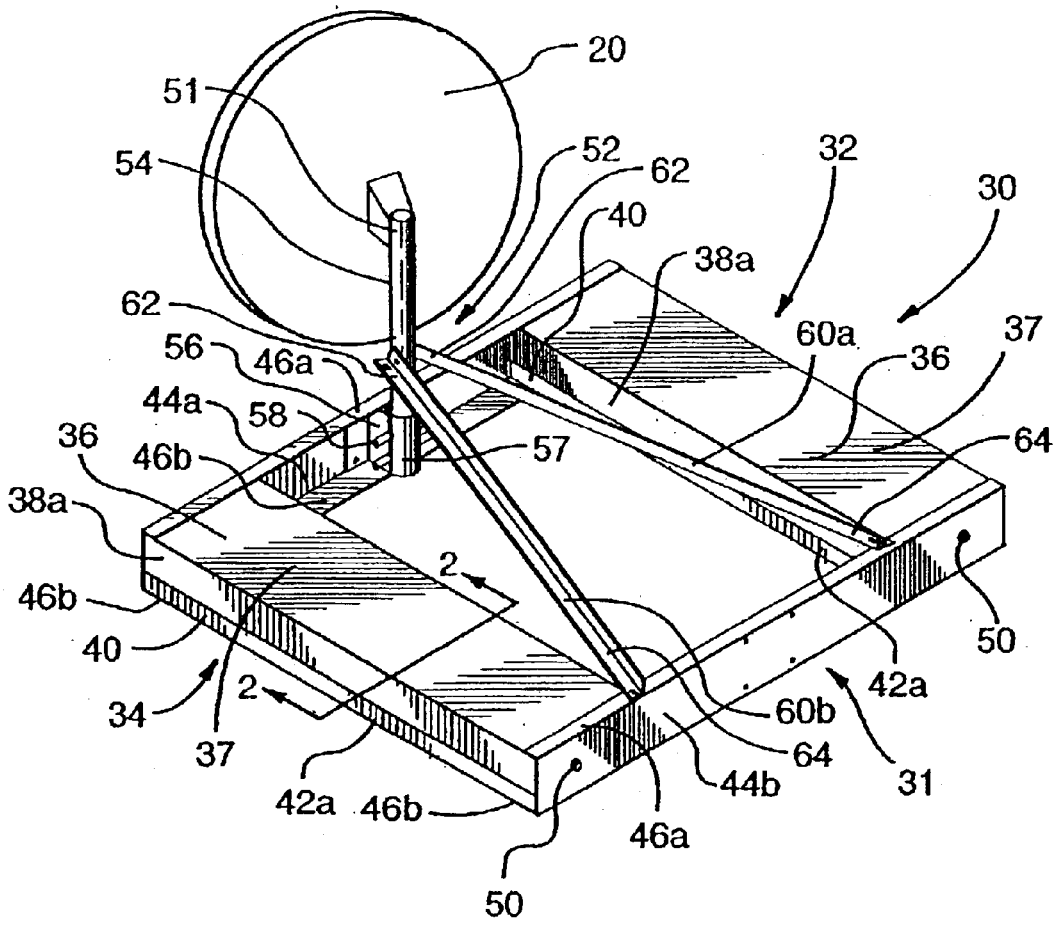
FIG. 1 is a rear perspective view of a secure non-penetrating flat roof mount for a satellite antenna and for use with a ballast according to the invention, attached to the satellite antenna, with said ballast comprising one or more ballasting members.
Figure 2:
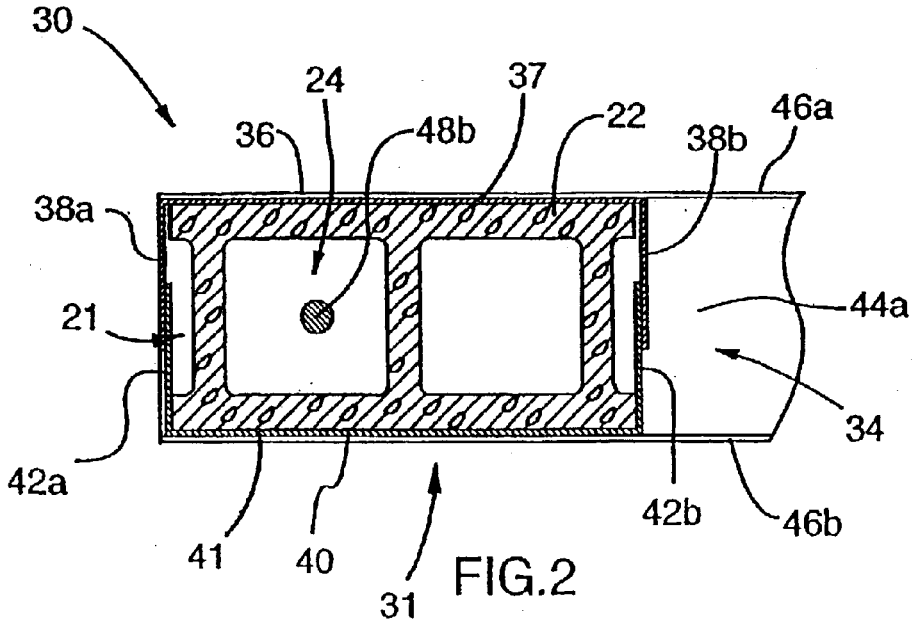
FIG. 2 is a sectional view along sight line 2—2 of FIG. 1, with one of said ballasting members visible in cross-section.
Figure 3:
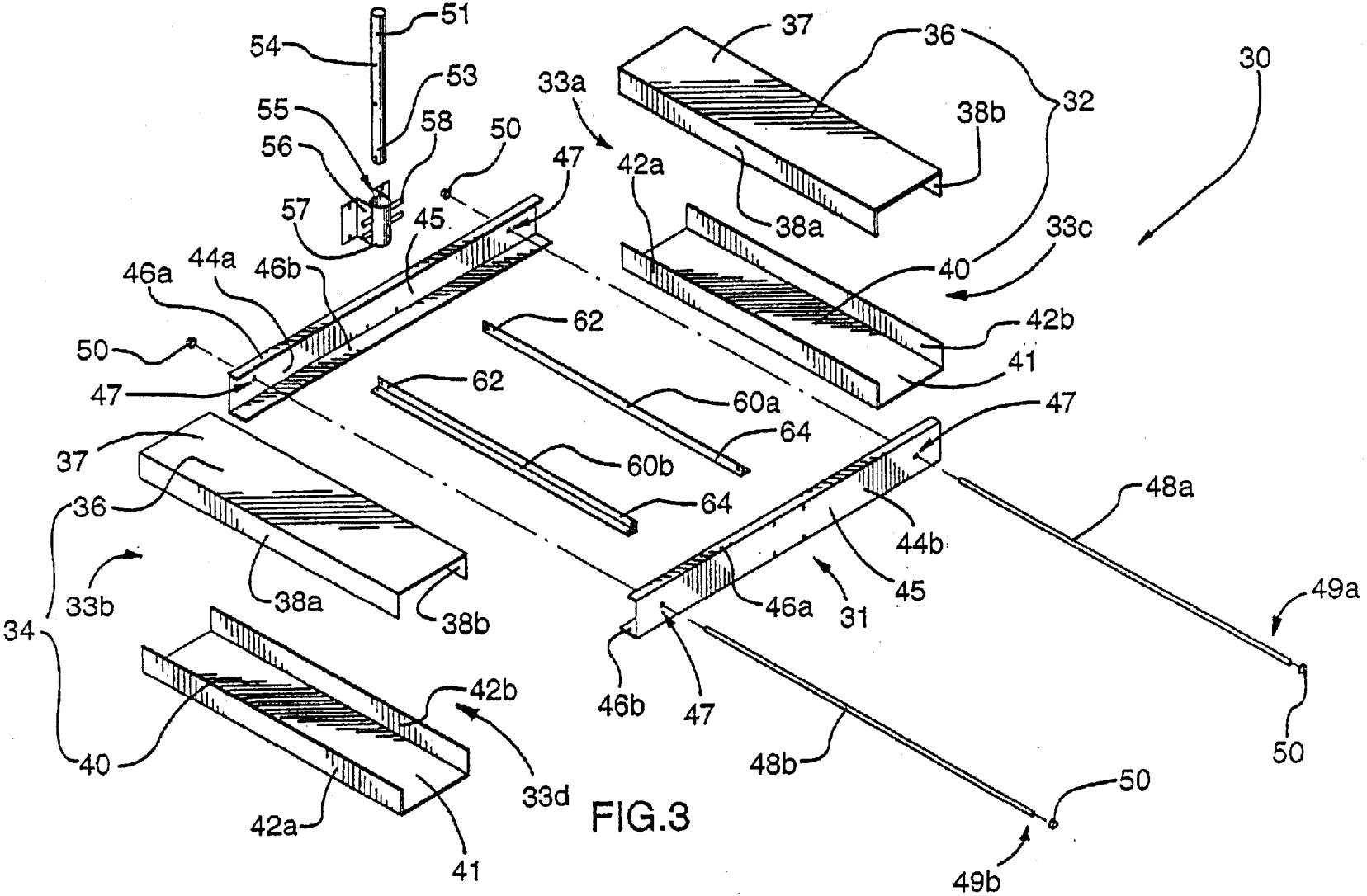
FIG. 3 is a rear perspective exploded view of the secure non-penetrating flat roof mount for a satellite antenna and for use with a ballast of FIG. 1, shown removed from the satellite antenna and the ballast.

Referring now to FIGS. 1 through 3 of the drawings, there is shown a preferred embodiment of a secure non-penetrating flat roof mount 30 for a satellite antenna 20 and for use with a ballast comprising first and second portions 21, with each of said first and second portions 21 of said ballast comprising one or more ballasting members 22. In FIG. 1, the secure non-penetrating flat roof mount 30 will be seen to comprise an antenna supporting member 52 and a base portion 31 that itself comprises first and second end caps 44*a*, 44*b*, a first ballast encasing member 32, and a second ballast encasing member 34, with each of said first and second end caps 44*a*, 44*b* adapted to securely and removably engage both of said first and second ballast encasing members 32, 34. Said antenna supporting member 52 is securely engagable with both of said first and second end caps 44*a*, 44*b*. The secure non-penetrating flat roof mount 30 further comprises first and second tie rod means 49*a*, 49*b* that respectively comprise threaded elongate first and second tie rod members 48*a*, 48*b* (as best seen in FIGS. 2 and 3). Said first and second tie rod members 48*a*, 48*b* are respectively positionable substantially within said first and second ballast encasing members 32, 34, respectively in first and second substantially adjacent relation to said first and second portions 21 of said ballast, and to said ballasting members 22, when in use. Further, each of said first and second tie rod members 48*a*, 48*b* is also respectively adapted to extend between, and to securely engage, both of said first and second end caps 44*a*, 44*b*.

Each of said first and second ballast encasing members 32, 34 comprises an upper member 36 and a lower member 40, with each said upper member 36 being elongate and having a "C"-shaped cross-section defined by an upper central base portion 37 and two opposed upper side edge portions 38*a*, 38*b*. Likewise, each said lower member 40 is also elongate and has a "C"-shaped cross-section defined by a lower central base portion 41 and two opposed lower side edge portions 42*a*, 42*b*. As best seen in FIG. 2, each of said two opposed upper side edge portions 38*a*, 38*b* is adapted to frictionally engage, in first overlapping relation, a respective one of said two opposed lower side edge portions 42*a*, 42*b*. More particularly, a first one of said two opposed upper side edge portions 38*a* is engagable with a first one of said two opposed lower side edge portions 42*a* in said first overlapping relation, and a second one of said two opposed upper side edge portions 38*b* is engagable with a second one of said two opposed lower side edge portions 42*b* in said first overlapping relation.

With reference to FIG. 3, it is appreciated that each of said first and second ballast encasing members 32, 34, in an assembled state (i.e., with said two opposed upper side edge portions 38*a*, 38*b* of the upper member 36 engaging said two opposed lower side edge portions 42*a*, 42*b* of the lower member 40 in said first overlapping relation), defines two open end faces. As such, the base portion 31 has first, second, third, and fourth open end faces, 33*a*, 33*b*, 33*c*, and 33*d* respectively—the first ballast encasing member 32 defining first and third open end faces 33*a*, 33*c*, and the second ballast encasing member 34 defining second and fourth open end faces 33*b*, 33*d*. Said first end cap 44*a* is adapted to securely and removably engage said first open end face 33*a* of said first ballast encasing member 32 as well as the corresponding second open end face 33*b* of said second ballast encasing member 34, and said second end cap 44*b* is adapted to securely and removably engage said third open end face 33*c* of said first ballast encasing member 32 and the corresponding fourth open end face 33*d* of said second ballast encasing member 34. The ballasting members 22 are thus encased within the first ballast encasing member 32 in a first encasing relation, and within the second ballast encasing member 34 in a second encasing relation, by the first and second end caps 44*a*, 44*b*, so as to provide the ballasting members 22 with an increased the resistance to the elements and to other external influences.

As best seen in FIGS. 1 and 3, each of said first and second end caps 44*a*, 44*b* is elongate and has a "C"-shaped cross-section defined by a cap central base portion 45 and two opposed cap side edge portions 46*a*, 46*b*. As best seen in FIG. 3, each of said first and second end caps 44*a*, 44*b* is shaped so as to define two tie-rod receiving apertures 47 therethrough. Each respective one of said two opposed cap side edge portions 46*a*, 46*b* is adapted to frictionally engage both said first and second ballast encasing members 32, 34 in a second overlapping relation. More particularly, a first one of said two opposed cap side edge portions 46*a* is adapted to frictionally engage both said upper member 36 of said first ballast encasing member 32, and said upper member 36 of said second ballast encasing member 34, in said second overlapping relation. Likewise, a second one of said two opposed cap side edge portions 46*b* engages both said lower member 40 of said first ballast encasing member 32, and said lower member 40 of said second ballast encasing member 34, in said second overlapping relation.

Also shown in FIGS. 1 and 3 is the fact that, in the preferred embodiment, each of said threaded elongate first and second tie rod members 48*a*, 48*b* is adapted to securely and respectively engage both of said first and second end caps 44*a*, 44*b* with the aid of two complementary threaded end cap securing tie rod fasteners 50.

As well, said antenna supporting member 52 will be seen to comprise an antenna mast bracket 56 that is securely engagable with said first end cap 44*a*, and that has a substantially cylindrical longitudinal sleeve portion 57. The longitudinal sleeve portion 57 has a sleeve end portion that defines a longitudinal antenna mast receiving aperture 55. The longitudinal sleeve portion 57 defines four threaded sockets arranged two each in two vertically aligned pairs of said threaded sockets. The antenna supporting member 52 further comprises four complementary threaded mast fasteners 58, each adjustably positionable in screw-threaded, throughpassing engagement within a respective one of said threaded sockets. As is appreciable from the positioning of said four complementary threaded mast fasteners 58 in FIG. 3, each of said vertically aligned pairs of said threaded sockets is positioned in axially intersecting, opposed relation, both relative to a cross-sectional center of said longitudinal sleeve portion 57 and relative to each other of said vertically aligned pairs of threaded sockets. The antenna supporting member 52 also comprises a substantially cylindrical elongate antenna mast 54 having a first mast end portion 53 that, in use, is substantially surrounded by said longitudinal antenna mast receiving aperture 55 in selectively removable secured relation, and is adjustably engaged by each of said mast fasteners 58. Further, said antenna supporting member 52 also comprises first and second antenna mast braces 60*a*, 60*b*, each securely engagable both with said antenna mast 54 and with said second end cap 44*b*.

In order to assemble and install the secure non-penetrating flat roof mount 30, both said lower member 40 of said first ballast encasing member 32, and said lower member 40 of said second ballast encasing member 34, are positioned on a flat roof top of a building (not shown), with said opposed lower side edge portions 42*a*, 42*b* facing in a substantially upward direction. Said one or more ballasting members 22 are then loaded on top of each said lower member 40, between said opposed lower side edge portions 42*a*, 42*b*. Preferably, and as best seen in FIG. 2, each of the ballasting members 22 is shaped so as to define a ballast tie-rod receiving aperture 24 therethrough. Examples of ballasting members 22 according to this general design include, inter alia, concrete and cinder blocks. Each ballast tie-rod receiving aperture 24 is preferably aligned with each other ballast tie-rod receiving aperture 24 of the ballasting members 22.

Next, the upper members 36, 36 of said first and second ballast encasing members 32, 34 are respectively positioned on the ballasting members 22 loaded on the lower members 40, 40 of said first and second ballast encasing members 32, 34, with said opposed upper side edge portions 38*a*, 38*b* of each said upper member 36 facing in a substantially downward direction. Further, each said upper member 36 is positioned such that each of said two opposed upper side edge portions 38*a*, 38*b* frictionally engages a respective one of said two opposed lower side edge portions 42*a*, 42*b* in said first overlapping relation. In this manner, said assembled state of said first and second ballast encasing members 32, 34 is effected, and each of said first and second ballast encasing members 32, 34 respectively defines said two open end faces. That is, said first ballast encasing member 32 defines said first and third open end faces, 33*a*, 33*c*, and said second ballast encasing member 34 defines said second and fourth open end faces, 33*b*, 33*d*.

The first and second ballast encasing members 32, 34 are then slightly elevated from the roof top, as each of said first and second end caps 44*a*, 44*b* is respectively positioned with each of said two opposed cap side edge portions 46*a*, 46*b* frictionally engaging both of said first and second ballast encasing members 32, 34 in said second overlapping relation. Accordingly, said first end cap 44*a* securely and removably engages said first and second open end faces, 33*a*, 33*b*, and said second end cap 44*b* securely and removably engages said third and fourth open end faces, 33*c*, 33*d*. Thus, said first and second ballast encasing members 32, 34 are secured and removably engaged, respectively in said first and second encasing relations, by said first and second end caps 44*a*, 44*b*. Next, each of said first and second tie rod members 48*a*, 48*b* is accommodated by a different one of said tie rod receiving apertures 47 shaped in said second end cap 44*b*, with said first and second tie rod members 48*a*, 48*b* respectively extending within said first and second ballast encasing members 32, 34, through each said ballast tie rod receiving aperture 24, and through a different one of said tie rod receiving apertures 47 shaped in said first end cap 44*a*. Thereafter, each of said first and second tie rod members 48*a*, 48*b* may be removably secured in place, relative to said first and second end caps 44*a*, 44*b*, by said two complementary threaded end cap securing tie rod fasteners 50.

At this stage, said antenna mast bracket 56 may be securely engaged with said first end cap 44*a*, such as, for example, by using any of a wide variety of fasteners or adhesives. Next, the first mast end portion 53 of the antenna mast 54 may be substantially surrounded by the longitudinal antenna mast receiving aperture 55, and each of said four mast fasteners 58 may be individually and adjustably positioned in screw-threaded, throughpassing engagement within each of said four threaded sockets, so as to adjustably engage said antenna mast 54 in selectively removable secured relation. A first brace end portion 62 of each of said first and second mast braces 60*a*, 60*b* is then securely engaged with said antenna mast 54, and a second brace end portion 64 of each of said first and second mast braces 60*a*, 60*b* is securely engaged with said second end cap 44*b*, such as, for example, by using any of a wide variety of fasteners or adhesives.

After having substantially assembled the secure non-penetrating flat roof mount 30 in this manner, and as best illustrated in FIG. 1, the satellite antenna 20 may then be securely connected to a second mast end portion 51 of said antenna mast 54, such as, for example, by using any of a wide variety of fasteners or adhesives. It will be noted that the secure non-penetrating flat roof mount 30 according to the invention is of a relatively simple construction that is easily assembled without the expenditure of significant time, effort, and resources. According to the preferred embodiment of the invention, as described in detail above, the ballasting members 22 are encased and effectively secured within each of the first and second ballast encasing members 32, 34, such that the weather and other external influences may not directly act upon same, thus increasing the resistance of the ballasting members 22 thereto. Further, the ballasting members 22 weightedly anchor the secure non-penetrating flat roof mount 30 in place on the roof top of the building, such that the satellite antenna 20 connected thereto is secured and stabilized in place. The security and stability of the satellite antenna 20 is further guaranteed by the presence of the four mast fasteners 58 and the first and second mast braces 60*a*, 60*b*.

As indicated above, the construction of the secure non-penetrating flat roof mount 30 effectively protects the ballasting members 22 from the erosive and potentially damaging effects of weathering and other external influences. Because the secure non-penetrating flat roof mount 30 according to the invention does not penetrate the roof top of the building, it reduces the possibility of roof leaks occasioned thereby. As well, in use of the preferred embodiment of the invention, the ballasting members 22 are positioned within both of said first and second ballast encasing members 32, 34, thereby effectively distributing the weight of the ballasting members 22, and the weight of the secure non-penetrating flat roof mount 30 itself, and thus reducing the possibility of water pooling on the roof. Accordingly, the possibility of roof leaks occasioned by the secure non-penetrating flat roof mount 30 is even further reduced. The possibility of water pooling is still further reduced, and the weight is even better distributed, when a foam sheet of a plastics material is positioned between the secure non-penetrating flat roof mount 30 and the roof top, as is customarily done in flat roof installations of this sort. As well, it is to be noted that, when the secure non-penetrating flat roof mount 30 for a satellite antenna 20 and for use with a ballast is assembled as shown in FIG. 1, each of the first and second ballast encasing members 32, 34 is slightly elevated from the roof top by a width of one of said two opposed cap side edge portions 46*b*, such that the possibility of water pooling and roof leaks is yet further reduced.

It should also be noted that the longitudinal antenna mast receiving aperture 55 may be any of a variety of sizes, so as to accommodate a wide range of diameters of the antenna mast 54 and of the satellite antenna 20 itself. As well, the individually and adjustably positionable nature of said four complementary threaded mast fasteners 58 further allows for a significant range of diameters of the antenna mast 54 and of the satellite antenna 20, without necessarily changing the size of the longitudinal antenna mast receiving aperture 55. As such, the secure non-penetrating flat roof mount 30 is adjustable, and the satellite antenna 20 may be any of a variety of sizes.

All portions of the secure non-penetrating flat roof mount 30 may be constructed from one or more metal or plastic materials, provided the materials are sufficiently resistant to the elements and other external influences, according to the invention. Examples of specific metal material which may be used according to the invention include, inter alia, galvanized 20, 14, and 12 ga. plate and angle, and schedule 40 galvanized pipe. Additionally, the construction materials are such as to ensure a durable and reliable construction and a design which is relatively inexpensive to manufacture. Furthermore, the construction materials are also selected, in part, so as to ensure a relatively light-weight construction, and to thereby minimize transportation costs, and the weight exerted on the roof top. Because the secure non-penetrating flat roof mount 30 is preferably shipped in a disassembled and relatively compact bundle, the transportation costs are even further reduced.

In order to disassemble the secure non-penetrating flat roof mount 30, or to facilitate the movement of same from one position to another, the above assembly and installation steps may simply be completed in reverse. Accordingly, the secure non-penetrating flat roof mount 30 is easily transportable and does not require extensive disassembly to be moved.

Other modifications and alterations may be used in the design and manufacture of the present invention without departing from its spirit and scope, which is limited only by the accompanying claims. For example, the secure non-penetrating flat roof mount 30 may be provided with only one ballast encasing member, itself having only one open end face, with comprising only one end cap and one tie rod member, which one tie rod member might securely engage said one end cap and said one ballast encasing member, and the antenna supporting member might likewise be provided with only one mast brace. Similarly, the secure non-penetrating flat roof mount 30 may be provided with more than two ballast encasing members and/or with more than two open end faces, end caps, and/or tie rod members. Further, more than one satellite antenna might be secured to a single secure non-penetrating flat roof mount. As well, further stability of the satellite antenna may be provided for by increasing the number of vertically aligned pairs of threaded sockets, the number of threaded sockets in each such vertically aligned grouping, or the number of mast braces. Likewise, the preferred embodiment described in detail above specifically contemplates the use of concrete and cinder blocks as ballasting members, but other materials could instead be used, such as, for example, a series of metal plates or a liquid ballast. As well, the secure non-penetrating flat roof mount 30 may also be modified so as to be any of a variety of sizes to better accommodate different quantities and/or sizes of ballasting members 22 and/or satellite antennas 20. Obviously, the present invention allows for a wide variety of different possible combinations of the various modifications and alterations specifically contemplated herein, and as such, it should perhaps be noted once again that the present invention is limited only by the accompanying claims.

We claim:

1. A secure non-penetrating flat roof mount, for a satellite antenna and for use with a ballast, comprising:

a) a base portion comprising:

i) a first ballast encasing member shaped and dimensioned to substantially enclose a first portion of said ballast and so as to define a first open end face; and ii) a first end cap adapted to securely and removably engage said first open end face in first encasing relation;

b) a first tie rod means securely engagable with said base portion to hold said first end cap in said first encasing relation, thereby to encase, in use, a first portion of said ballast; and c) an antenna supporting member securely engagable with said base portion.

2. A secure non-penetrating flat roof mount according to claim 1, wherein said first ballast encasing member is elongate in shape.

3. A secure non-penetrating flat roof mount according to claim 2, wherein said base portion further comprises an elongate second ballast encasing member oriented substantially parallel to said first ballast encasing member.

4. A secure non-penetrating flat roof mount according to claim 3, wherein said second ballast encasing member is shaped and dimensioned to substantially enclose a second portion of said ballast and so as to define a second open end face, with said first end cap also adapted to securely and removably engage said second open end face in second encasing relation.

5. A secure non-penetrating flat roof mount according to claim 4, further comprising a second tie rod means securely engagable with said base portion to hold said first end cap in said second encasing relation, thereby to encase, in use, a second portion of said ballast.

6. A secure non-penetrating flat roof mount according to claim 5, wherein said first ballast encasing member is further shaped and dimensioned so as to define a third open end face, wherein said second ballast encasing member is further shaped and dimensioned so as to define a fourth open end face, and wherein said base portion further comprises a second end cap adapted to securely and removably engage both said third open end face in said first encasing relation and said fourth open end face in said second encasing relation.

7. A secure non-penetrating flat roof mount according to claim 6, wherein said first tie rod means comprises an elongate first tie rod member positionable, in use, substantially within said first ballast encasing member and in first substantially adjacent relation to said first portion of said ballast, and wherein said second tie rod means comprises an elongate second tie rod member positionable, in use, substantially within said second ballast encasing member and in second substantially adjacent relation to said second portion of said ballast, with said first tie rod member and said second tie rod member each being adapted to securely respectively engage said first end cap and said second end cap.

8. A secure non-penetrating flat roof mount according to claim 7, wherein each of said first ballast encasing member and said second ballast encasing member comprises an upper member and a lower member, with said lower member of said first ballast encasing member being adapted to securely and removably engage said upper member of said first ballast encasing member to substantially enclose said first portion of said ballast as aforesaid, with said lower member of said second ballast encasing member being adapted to securely and removably engage said upper member of said second ballast encasing member to substantially enclose said second portion of said ballast as aforesaid, with each said upper member having a "C"-shaped cross-section defined by an upper central base portion and two opposed upper side edge portions, and with each said lower member having a "C"-shaped cross-section defined by a lower central base portion and two opposed lower side edge portions.

9. A secure non-penetrating flat roof mount according to claim 8, wherein each of said two opposed upper side edge portions being adapted to frictionally engage, in first overlapping relation, a respective one of said two opposed lower side edge portions.

10. A secure non-penetrating flat roof mount according to claim 9, wherein each of said first end cap and said second end cap is elongate and has a "C"-shaped cross-section defined by a cap central base portion and two opposed cap side edge portions, and with each respective one of said two opposed cap side edge portions being adapted to frictionally engage, in second overlapping relation, both said first ballast encasing member and said second ballast encasing member.

11. A secure non-penetrating flat roof mount according to claim 10, wherein said antenna supporting member comprises an antenna mast bracket and an elongate antenna mast, with said antenna mast bracket being securely engagable with both said base portion and said antenna mast.

12. A secure non-penetrating flat roof mount according to claim 11, wherein said antenna mast has a first mast end portion, and wherein said antenna mast bracket comprises a longitudinal sleeve portion having a sleeve end portion, with said sleeve end portion being shaped so as to define a longitudinal antenna mast receiving aperture, with said longitudinal antenna mast receiving aperture substantially surrounding, in use, said first mast end portion in selectively removable secured relation.

13. A secure non-penetrating flat roof mount according to claim 12, wherein said longitudinal sleeve portion of said antenna mast bracket further defines four threaded sockets arranged two each in two vertically aligned pairs of said threaded sockets, with said antenna supporting member further comprising four complementary threaded mast fasteners, with each of said mast fasteners being adjustably positionable in screw-threaded, throughpassing engagement within a respective one of said threaded sockets, thereby to adjustably engage said antenna mast in selectively removable secured relation.

14. A secure non-penetrating flat roof mount according to claim 13, wherein each of said vertically aligned pairs of said threaded sockets is positioned in axially intersecting, opposed relation, relative to each other of said vertically aligned pairs of said threaded sockets and relative to a cross-sectional center of said longitudinal sleeve portion.

15. A secure non-penetrating flat roof mount according to claim 14, wherein said antenna supporting member further comprises a first mast brace securely engagable with both said antenna mast and said base portion.

16. A secure non-penetrating flat roof mount according to claim 15, wherein said antenna supporting member is securely engagable with both said first end cap and said second end cap.

17. A secure non-penetrating flat roof mount according to claim 16, wherein said antenna mast bracket is securely engagable with said first end cap.

18. A secure non-penetrating flat roof mount according to claim 17, wherein said antenna supporting member further comprises a second mast brace, with both said first mast brace and said second mast brace being securely engagable with both said antenna mast and said second end cap.

19. A secure non-penetrating flat roof mount according to claim 18, wherein both of said antenna mast and said longitudinal sleeve portion are substantially cylindrical in shape.

* * * * *